United States Patent [19]

Spehrley, Jr. et al.

[11] Patent Number: 4,928,120

[45] Date of Patent: May 22, 1990

[54] ORIFICE PLATE CLEANER FOR HOT MELT INK JET

[75] Inventors: Charles W. Spehrley, Jr., Hartford; Steven H. Barss, Norwich; David G. Tomaszewski, Sharon; Paul A. Hoisington, Thetford Center, all of Vt.

[73] Assignee: Spectra, Inc., Hanover, N.H.

[21] Appl. No.: 275,096

[22] Filed: Nov. 21, 1988

[51] Int. Cl.[5] ..... B41J 2/165

[52] U.S. Cl. ..... 346/140 R

[58] Field of Search ..... 346/140, 1.1

[56] References Cited

U.S. PATENT DOCUMENTS

| | | | |
|---|---|---|---|
| 4,223,322 | 9/1980 | va Rammsdonk | 346/140 |
| 4,369,456 | 1/1983 | Cruz-Uribe | 346/140 |
| 4,450,456 | 5/1984 | Jekez | 346/140 |
| 4,571,601 | 2/1986 | Teshima | 346/140 |

*Primary Examiner*—Joseph W. Hartary
*Attorney, Agent, or Firm*—Brumbaugh, Graves, Donohue & Raymond

[57] ABSTRACT

In the embodiment of the cleaning device described in the specification, a web of paper is movable past the orifice plate of an ink jet head from a supply roll to a take-up roll. The cleaning device has a movable front end portion with two pressure bars positioned to urge the web of paper against two portions of the orifice plate, one portion being in line with the orifices and the other below the orifices. The pressure bar supports are arranged so that the bar positioned in line with the orifices engages the web after the other bar has urged the web against the orifice plate. The cleaning device also collects ink ejected during purging of air from the system and may be positioned to prevent ejection of ink during an internal purging operation.

20 Claims, 2 Drawing Sheets

ORIFICE PLATE CLEANER FOR HOT MELT INK JET

BACKGROUND OF THE INVENTION

This invention relates to devices for cleaning ink from the orifice plates in ink jet systems and, more particularly, to a new and improved cleaning device for an ink jet orifice plate in a hot melt ink jet system.

In ink jet systems, the orifice plate from which ink drops are ejected tends to accumulate a quantity of ink because of accidents during operation, spattering of ink as a result of tails or satellites in the ink drops, and purging of air from the ink supply lines. In hot melt ink systems, the ink jet head is held at a high temperature so that the ink which accumulates on the orifice plate remains liquid during operation of the system. Consequently, drops may be released from the surface of the orifice plate during printing and deposited on the print medium, producing a defective print, or into the mechanism, causing reliability problems.

Heretofore, wiper blades have proposed for scraping molten hot melt ink from the surface of an orifice plate in a hot melt ink jet system, but once the ink has been removed, it solidifies on the wiper blade, presenting difficulty when the blade is to be used again. Other cleaning systems using replaceable ink-receiving media such as paper or cloth have been proposed or used. In one case, for example, a D-shaped roller made of resilient material is normally oriented with its flat surface facing the printhead so as to avoid contact with the orifice plate. When cleaning is required, a cloth web held against the D-shaped roll is advanced, causing the roll to rotate so that the web is pressed against the orifice plate during three-quarters of the rotation of the roll. In that case, the pressure applied to the orifice plate varies depending on the compliance of the resilient material of which the roll is made and the tension in the cleaning web, causing variations in the pressure and permitting relatively high pressures to be applied to the orifice plate which can result in abrasive deterioration of the plate.

SUMMARY OF THE INVENTION

Accordingly, it is an object of the present invention to provide a new and improved cleaning device for the orifice plate in an ink jet system which overcomes the above-mentioned disadvantages of the prior art.

Another object of the invention is to provide an orifice plate cleaning device in which the pressure applied to the orifice plate can be carefully controlled.

A further object of the invention is to provide an orifice plate cleaning device which cooperates in the purging of air from ink in the hot melt ink jet system.

These and other objects of the invention are attained by providing an ink-receiving medium which is movable with respect to the orifice plate and a resiliently supported pressure member for urging the movable medium against the orifice plate with a selected pressure. In one embodiment, the medium comprises a web which is moved across the surface of the orifice plate and a pair of pressure bars selectively movable toward the orifice plate at spaced positions, one position being beneath the orifices in the orifice plate and the other being in line with the orifices in the orifice plate, so as to retain the medium in contact with the orifice plate at a controlled low pressure.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
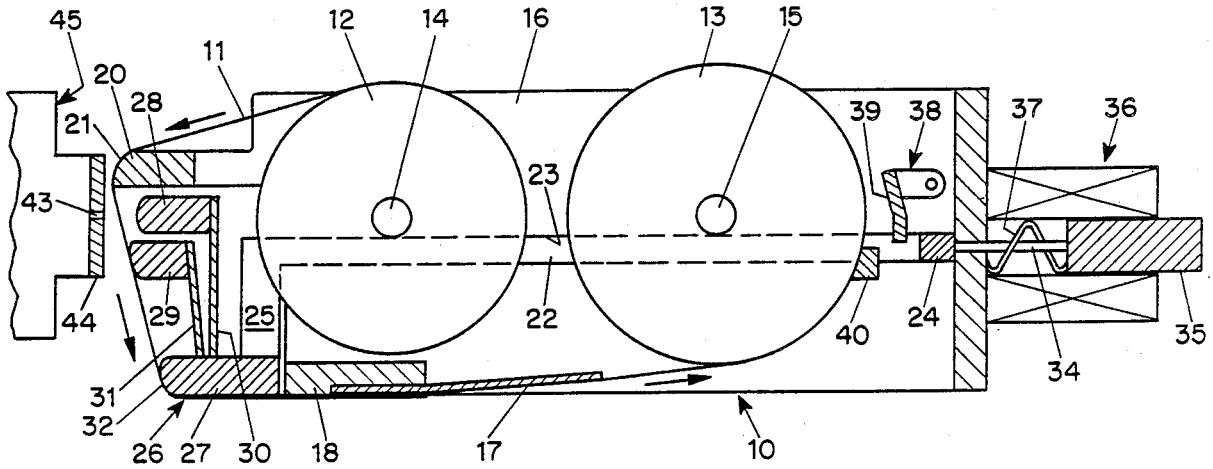
FIG. 1 is a schematic view in longitudinal section illustrating a representative embodiment of an orifice plate cleaning device in accordance with the invention in the retracted condition.

In the typical embodiment of the invention shown in FIG. 1, a cleaning device 10 includes a web 11 of paper which is conveyed during operation from a supply roll 12 to a take-up roll 13 in the direction indicated by the arrows. The supply roll 12 and the take-up roll 13 are mounted on corresponding spindles 14 and 15, respectively, which extend from one sidewall 16 of the device 10 to an opposite sidewall not shown in the sectional view of FIG. 1, and the take-up spindle 16 is driven as required by a drive motor (not shown) to move the paper web in the direction of the arrows.

The supply roll 12 initially contains about 500 inches of any conventional paper of a type capable of absorbing molten hot melt ink readily and, during operation, the paper is driven from the supply roll to the take-up roll at a rate of about 2 to 4 inches per second. To prevent the web 11 of paper from becoming loose in its path between the supply roll 12 and the take-up roll 13, the supply roll spindle 14 is tensioned in an appropriate manner. In addition, a leaf spring member 17, mounted in a fixed crossbar 18 extending between the sidewalls at the bottom of the device 10, assists in preventing the web 11 from becoming slack between the supply roll 12 and the take-up roll 13. The sidewall 16 and the opposite sidewall are also connected by a rear wall 19 and a fixed front crossbar 20 which has a rounded surface 21 shaped to guide the web 11 smoothly around the front end of the device 10.

Two longitudinal bars 22, only one of which is visible in the drawings, extend in corresponding grooves 23 in the sidewalls and are connected at their ends by a rear crossbar 24. At the front end of the device, the bars 22 have downward extensions 25 by which they are connected to a movable front end portion 26 of the device. The movable front end portion includes a crossbar 27 to which the downward extensions 25 are connected and two pressure bars 28 and 29 which are resiliently mounted on the movable crossbar 27 by spring members 30 and 31, respectively. As with the crossbar 20, the forward end of the movable crossbar 27 is shaped with a curved surface 32 to guide the web 11 smoothly from the front to the bottom of the device 10. One of the pressure bars 28 is supported behind the paper web 11 at a location in line with the orifices 43 in an orifice plate 44 in an ink jet head 45, and the other pressure bar 29 is positioned behind the web at a lower position in line with the lower part of the orifice plate 44.

Thus, the entire assembly consisting of the crossbar 24, the longitudinal bars 22 with their extensions 25, the crossbar 27 and the resiliently mounted pressure bars 28 and 29 is movable toward and away from the orifice plate 44. Moreover, as shown in FIG. 1, the front end of the lower pressure bar 29 is positioned closer to the orifice plate 44 than the front end of the upper pressure bar 28 to cause the lower pressure bar to force the web 11 against the orifice plate before the upper pressure bar reaches the orifice plate.

Figure 2:
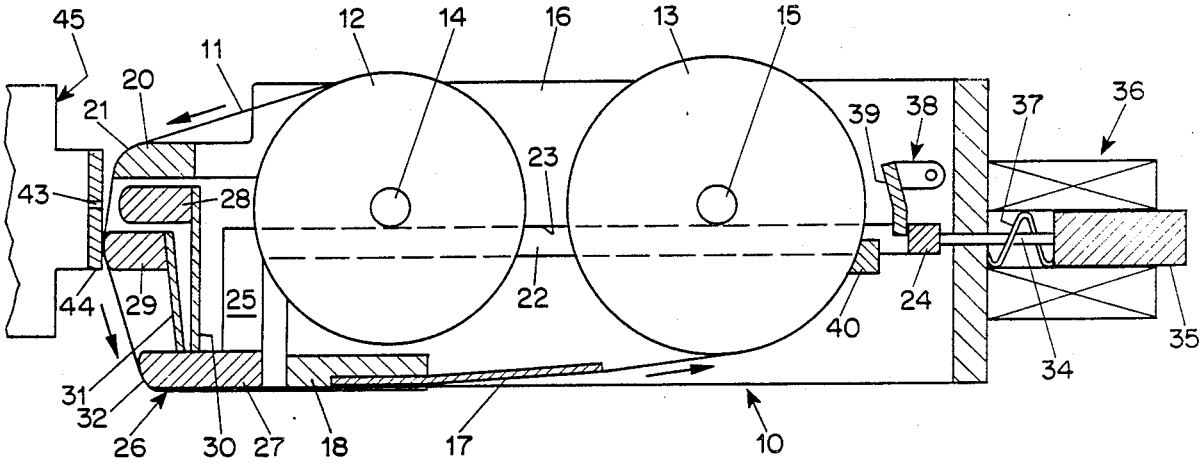
FIG. 2 is a view of the device shown in FIG. 1 with the cleaning mechanism in partly extended condition.
Figure 3:
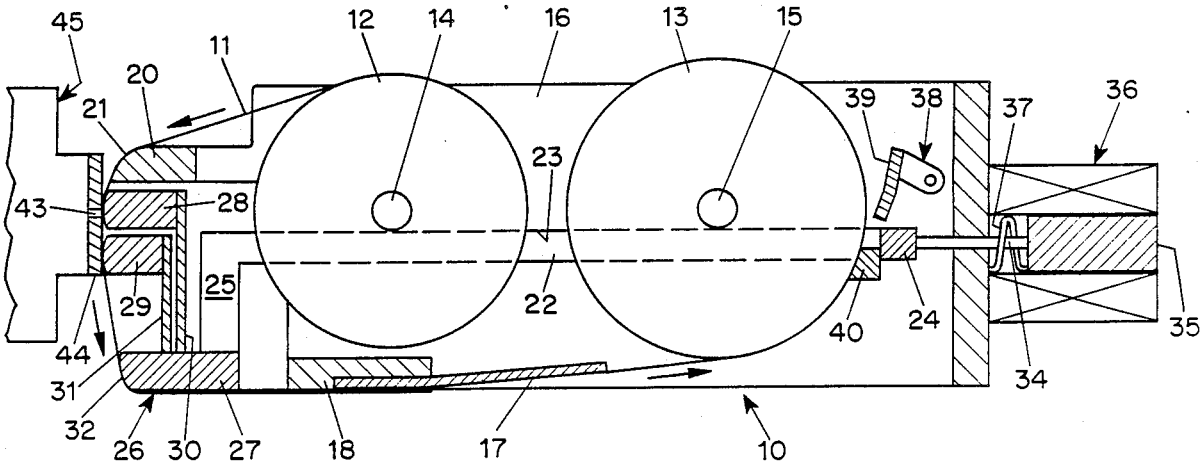
FIG. 3 is a view of the device shown in FIG. 1 with the cleaning mechanism in fully extended position.

Preferably, the front surface of the upper pressure bar 28 is positioned about 0.02 inch behind the front face of the lower pressure bar 29 so that it does not engage the web 11 in the partially extended condition illustrated in FIG. 2, but engages the web with the desired pressure in the fully extended position illustrated in FIG. 3. In the condition shown in FIG. 2, the web 11 is preferably spaced at least 0.01 inch away from the surface of the orifice plate 44 in the region of the orifices 43.

In order to control the position of the movable front end portion 26 of the cleaning device, the crossbar 24 is connected by a shaft 34 to the plunger 35 of a solenoid 36 which is normally retained in the rearmost position shown in FIG. 1 by a spring 37. In order to permit limited forward motion of the assembly 31 when the solenoid 36 is actuated, a movable stop assembly 38 has a stop arm 39 which may be moved downwardly into the path of the crossbar 24, limiting the forward motion of the bar and the corresponding front end portion 26 when the solenoid 36 is actuated, as shown in FIG. 2. When the movable stop assembly 38 is moved upwardly out of the path of the crossbar 24 in the manner shown in FIG. 3, actuation of the solenoid 36 moves the crossbar 24 farther forward against a fixed stop 40, permitting full forward motion of the front end portion 26.

In the operation of the ink jet system, the ink jet head 45 is displaced from a home position adjacent to the cleaning device 10 and is transported close to the surface of a record member to project ink drops onto the record member to form a desired image or pattern during which ink may accumulate on the surface of the orifice plate 44. Accordingly, the head 45 is periodically restored to the home position adjacent to the cleaning device as shown in FIG. 1. When the ink jet head is in the home position, the cleaning device can be actuated to remove any ink accumulated on the orifice plate or it may cooperate in purging of air from the ink jet head in the manner described hereinafter.

In one mode of operation, the ink jet head is restored to the home position periodically, for example, after printing about five or ten pages, and the front end portion 26 is fully advanced in the manner shown in FIG. 3 so that both bars 28 and 29 urge the paper web 11 against the orifice plate at and below the region of the orifices 43. In this case, the paper is kept stationary and held for a short time, such as one or two seconds, against the orifice plate to blot any ink on the surface of the orifice plate. Thereafter, the front end portion 26 is retracted to the position shown in FIG. 1 and the paper web 11 is advanced just enough, for example, one-quarter inch, to move the portion containing blotted ink out of the immediate region of the orifices.

Upon initial start-up of an ink jet system after ink has been solidified, the cleaning device is automatically set to facilitate the purging of any air trapped in the system by cross-flow purging, in which the ink containing trapped air is conveyed from the ink jet head to an internal air-purging device of the type described, for example, in the Hoisington et al. Application Serial No. 043,372, filed April 28, 1987 now Patent No. 4788556.

For this purpose, the cleaning device is set in the condition illustrated in FIG. 3, with both pressure bars 28 and 29 urging the paper web 11 against the orifice plate 44 and an internal pressure of about 1 to 3 psi is applied to cause the ink to flow from the head to the internal deaeration device. In this case, to reduce abrasion, the web 11 is advanced between the supply roll 12 and the take-up roll 13 at a relatively low rate, such as less than two inches per second, in order to prevent any ink from spreading to a region on the surface of the orifice plate above the orifices. To make certain that pressure applied internally to transfer the ink within the head does not separate the web from the orifice plate, the upper pressure bar and its resilient support spring 30 provide a force of about one-half pound against the paper. With a face contact area of about 0.05 inch by 3 inches, this is sufficient to resist internal ink pressures on the order of 1 to 3 psi. After such crosspurging is completed, the web 11 is driven a short distance to remove any ink from the orifice plate before the front end portion 26 of the device is retracted by de-energization of the solenoid 36.

Such cross-flow purging may also be initiated by the operator if a deterioration in print quality is detected during operation. If the print quality is not improved by cross-flow purging, the operator may set the device to the condition shown in FIG. 2 for outflow purging. To permit such outflow purging and to clean the lower portion of the orifice plate 44, the stop assembly 38 is positioned so that the stop bar 39 will limit the forward motion of the assembly front end portion 26 as shown in FIG. 2. In this position, the lower pressure bar 29 urges the paper web 11 against the lower part of the orifice plate 44, leaving the web spaced from the orifices 43 in the orifice plate. A higher pressure, such as about 10 psi, is then applied to the ink so that the ink is ejected from the orifices toward the spaced web 11 to positively force any trapped air from the ink jet head.

During this operation, the paper web is driven in the direction of the arrows at a high enough rate, such as about two to four inches per second, to spread the ink in a thin layer, such as 10 to 30 mils thick, on the paper, and it is then carried with the web onto the take-up roll 13. After outflow purging has been accomplished in this manner, the motion of the web 11 is stopped and the stop assembly 38 is released, permitting the front end portion 26 to move farther forward so that the upper pressure bar 28 urges the stationary paper web 11 against the orifice plate 44 in the region of the orifices 43 in the manner shown in FIG. 3. The web is then moved at a slower rate of, for example, less than two inches per second, for a short time to remove any ink remaining on the orifice plate in the vicinity of the orifices, after which the front end portion 26 is retracted.

In a representative example of an orifice plate cleaning device of the type shown in FIGS. 1–3, the pressure bar support springs 30 and 31 have a spring constant of about 10 pounds per inch of deflection so that, when each of the bars 28 and 29 is deflected about 0.05 inch, the force applied by the spring to the pressure bar is about one-half pound. Since a variation of about 20% in the force produced by the spring is permissible, the dimensional tolerances may be large enough so that the structure is convenient and commercially viable.

Figure 4:
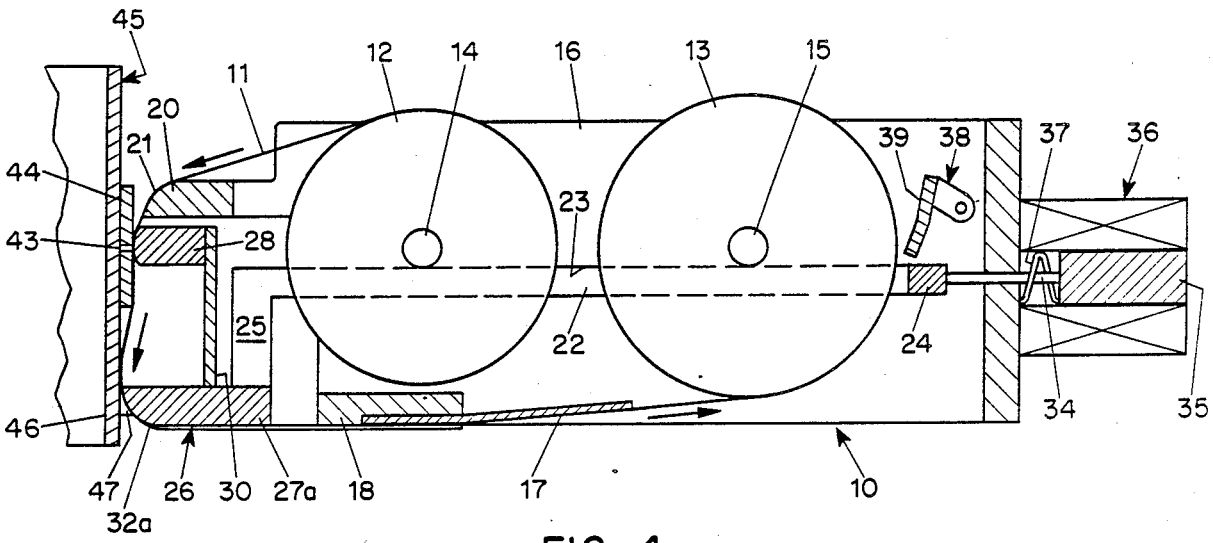
FIG. 4 is a schematic view similar to FIG. 3, showing an alternative embodiment of an orifice plate cleaning device in accordance with the invention.
Figure 5:
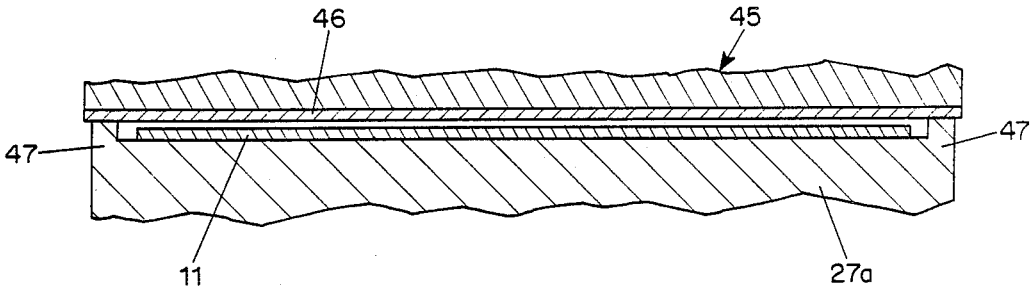
FIG. 5 is a fragmentary cross-sectional view illustrating the spacing of the cleaning web from the ink jet head in the embodiment shown in FIG. 4.

FIGS. 4 and 5 illustrate an alternative embodiment of the invention. In these figures, the reference numerals of FIGS. 1–3 are used to identify the same components described with respect to those figures. In this embodiment, only one pressure bar 28 is provided, and the movable front end portion 26 is arranged to engage the surface of a face plate 46 of the ink jet head. Moreover, since the position of the paper web 11 is defined by the position of the movable front end portion 26 adjacent to the face plate 46, the second pressure bar 29 and support spring 31 of the embodiment of FIGS. 1–3 are omitted, as is the fixed stop 40 of the embodiment of FIGS. 1–3.

In order to hold the web 11 against the lower portion of the orifice plate 44 in this embodiment, the crossbar 27*a* of the movable front end portion 26 has a faceplate-engaging projection 47 at each end and a web guide surface 32*a*, which is curved to guide the web 11 from the region adjacent to the faceplate 45 to the path extending beneath the device 10 to the take-up roll 13. In addition, the front surface 32*a* of the crossbar 27*a* terminates at an angle of about 45° to the plane of the faceplate and is spaced approximately 0.006 to 0.010 inch rearwardly of the front end of the projections 47.

With this arrangement, the beam strength of the paper web 11 urges the web into engagement with the orifice plate in the region between the pressure bar 28 and the movable crossbar 27*a*, providing an urging pressure similar to that of the spring-biased lower pressure bar 29 in the embodiment of FIGS. 1–3 so that the web absorbs and removes any ink on the portion of the orifice plate 44 below the orifices 43. Moreover, the urging pressure is normally sufficient to provide such engagement even when the movable front end portion is in the partialy extended position corresponding to that shown in FIG. 2, and the projections 47 of the movable crossbar 27*a* are not in engagement with the faceplate 46.

Although the invention has been described herein with reference to specific embodiments, many modifications and variations of the invention will readily occur to those skilled in the art. Accordingly, all such variations and modifications are included within the intended scope of the invention.

We claim:

1. Apparatus for cleaning an orifice plate in a hot melt ink jet head comprising web means supported for motion toward an orifice plate of a hot melt ink jet head, movably supported pressure bar means for engaging the web means and urging the web means against the orifice plate, and means for moving the pressure bar means toward the orifice plate to urge the bar means against the web means with a selected force.

2. Apparatus in accordance with claim 1 wherein the pressure bar means causes the web means to engage the orifice plate with a pressure in the range from about 1 to 3 psi.

3. Apparatus in accordance with claim 1 including web drive means for moving the web means with respect to the orifice plate and the pressure bar means to displace the portion of the web means adjacent to the orifice plate.

4. Apparatus in accordance with claim 1 including web spacing means having a portion adapted to engage the ink jet head and another portion adapted to position the web means with respect to the ink jet head.

5. Apparatus for cleaning an orifice plate in a hot melt ink jet head comprising web means supported for motion toward an orifice plate of a hot melt ink jet head, pressure bar means for engaging the web means and urging the web means against the orifice plate, and means for moving the pressure bar means toward the orifice plate to urge the bar means against the web means with a selected force wherein the pressure bar means comprises a first resiliently supported bar for urging the web means against one portion of the orifice plate and a second resiliently supported bar for urging the web means against another portion of the orifice plate.

6. Apparatus in accordance with claim 5 wherein the first resiliently supported bar urges the web means against the portion of the orifice plate in which orifices are located, and the second resiliently supported bar urges the web means against the orifice plate below the portion in which the orifices are located.

7. Apparatus in accordance with claim 5 wherein the portion of the second resiliently supported bar which engages the movable web means is normally positioned closer to the orifice plate than the portion of the first resiliently supported bar which engages the web means.

8. Apparatus in accordance with claim 7 including means for moving the resilient bar means toward the orifice plate far enough to permit the second resiliently supported bar to cause the web means to engage the orifice plate, but not far enough to permit the first resiliently supported bar to cause the web means to engage the corresponding portion of the orifice plate.

9. Apparatus in accordance with claim 8 wherein the drive means includes means for moving the resilient bar means toward the orifice plate far enough to permit the first resiliently supported bar to cause the web means to engage the corresponding portion of the orifice plate.

10. A method for cleaning an orifice plate in a hot melt ink jet head comprising providing a movable web and urging the movable web toward the orifice plate with a movable supported bar so that the web engages a portion of the orifice plate.

11. A method in accordance with claim 10 including moving the movable web after it has engaged the orifice plate.

12. A method in accordance with claim 11 including disengaging the web from the orifice plate and wherein the motion of the web is initiated after the web has been disengaged from the orifice plate.

13. A method in accordance with claim 12 wherein the motion of the web is initiated while the web is engaged with the orifice plate.

14. A method in accordance with claim 13 wherein the web is moved at a rate of less than two inches per second.

15. A method in accordance with claim 11 wherein the web is moved at a rate of about two to four inches per second.

16. A method for cleaning an orifice plate in a hot melt ink jet head comprising providing a movable web and urging the movable web toward the orifice plate with a movably supported bar so that the web engages a selected portion of the orifice plate comprising moving a second movably supported bar against the movable web to cause it to engage a different portion of the orifice plate.

17. A method for cleaning an orifice plate containing orifices comprising engaging a movable web with a portion of the orifice plate spaced from the portion containing the orifices, displacing the movable web to clean the portion spaced from the portion containing the orifices without engaging the web with the portion containing the orifices, disengaging the movable web from the orifice plate, and displacing the portion of the web which engaged the orifice plate.

18. A method for purging an ink jet system having an orifice plate containing orifices comprising engaging a movable web with the portion of an orifice plate containing orifices with sufficient pressure to counteract internal ink pressure in the ink jet head, and applying pressure to the ink in the ink jet head to transfer ink internally therein away from the region of the orifices.

19. A method in accordance with claim 18 including moving the web while it is in engagement with the orifice plate.

20. A method for purging an ink jet system having an orifice plate containing orifices comprising engaging a movable web with a portion of the orifice plate adjacent to the orifices therein while retaining the web in spaced relation to the orifices, ejecting ink from the orifices, urging the web against the portion of the orifice plate containing the orifices, moving the web to remove ink from the surface of the orifice plate, and disengaging the movable web from the orifice plate.

* * * * *

UNITED STATES PATENT AND TRADEMARK OFFICE

CERTIFICATE OF CORRECTION

PATENT NO. : 4,928,120

DATED : May 22, 1990

INVENTOR(S) : Charles W. Spehrley, Jr. et al.

It is certified that error appears in the above-identified patent and that said Letters Patent is hereby corrected as shown below:

First page, Item 56, 3rd line: The word "va" should read --van--.

Column 6, line 40: The word "movable" should read --movably--; line 49: The words "claim 12" should read --claim 11--.

Signed and Sealed this

Twenty-ninth Day of October, 1991

*Attest:*

*Attesting Officer*

HARRY F. MANBECK, JR.

*Commissioner of Patents and Trademarks*